US011490211B2

(12) United States Patent
Liu et al.

(10) Patent No.: US 11,490,211 B2
(45) Date of Patent: Nov. 1, 2022

(54) DIRECTIVITY HEARING-AID DEVICE AND METHOD THEREOF

(71) Applicant: AWNT LIMITED, New Taipei (TW)

(72) Inventors: Yi-Chang Liu, New Taipei (TW); Li-Min Sun, Beijing (CN)

(73) Assignee: AWNT LIMITED, New Taipei (TW)

( * ) Notice: Subject to any disclaimer, the term of this patent is extended or adjusted under 35 U.S.C. 154(b) by 0 days.

(21) Appl. No.: 17/369,922

(22) Filed: Jul. 7, 2021

(65) Prior Publication Data

US 2022/0014859 A1 Jan. 13, 2022

(30) Foreign Application Priority Data

Jul. 7, 2020 (TW) ..... 109122920

(51) Int. Cl.
*H04R 25/00* (2006.01)

(52) U.S. Cl.
CPC ..... *H04R 25/407* (2013.01); *H04R 2225/41* (2013.01)

(58) Field of Classification Search
CPC ..... H04R 25/407; H04R 25/41
USPC ..... 381/313
See application file for complete search history.

(56) References Cited

U.S. PATENT DOCUMENTS

2020/0296521 A1* 9/2020 Wexler ..... H04N 5/2252

FOREIGN PATENT DOCUMENTS

WO WO-2021038295 A1 * 3/2021 ..... G06F 1/163

* cited by examiner

*Primary Examiner* — Phylesha Dabney

(57) ABSTRACT

The present disclosure relates a directivity hearing-aid device which primarily includes an audio pick-up device, a processor, a selector, and a speaker disposed in a case. The audio pick-up device receives a sound in a range which is pointed by a beam, and the processor generates a detected sound component by amplifying a sound feature point audio in a sound component corresponding to a detecting target which is selected by the selector and generates adjusted sound components by suppressing or shielding the sound feature point audio in the other sound components. Then the processor combines the detected sound component and the adjusted sound components to generate an output sound signal. Accordingly, the directivity hearing-aid device of the present disclosure provides selectively receiving the detected sound component and suppressing or shielding the other impurity sounds to facilitate the user hears audio from a specific object thereby.

16 Claims, 7 Drawing Sheets

DIRECTIVITY HEARING-AID DEVICE AND METHOD THEREOF

CROSS-REFERENCE TO RELATED APPLICATION

The present disclosure is based upon and claims priority to Taiwan Patent Application No. 109122920, filed on Jul. 7, 2020, the content of which is incorporated herein by reference in its entirety for all purposes.

BACKGROUND

1. Technical Field

The present disclosure relates to a field of directivity hearing-aid, and more particularly to a directivity hearing-aid device and method thereof for capturing the sound of a specific object in a specific direction.

2. Description of the Related Art

In a noisy environment, it is difficult to hear a sound of a specific object in this environment since the environmental sound in the surroundings or other sounds would easily drown out the sound of the specific object (e.g. classmates are too loud during class leads to not being able to hear the voice of the teacher, or a user cannot hear birds chirping in the natural environment since the noise from the tree leaves caused by the speedy wind, or the roar of the river).

In this case, a sound collector of the prior art may be installed on an audio pick-up device, so that a physical constriction method may be applied on the audio pick-up device to focus on receiving the sound in the pick-up direction.

However, the method cannot effectively distinguish and listen to the sound from the specific object when a plurality of high-decibel sounds are received in the pick-up direction. In addition, physical constriction may easily make noise due to speedy wind that may be interfere the reception of the sound pick-up device in an external environment, hence to affect the determination of the sounds.

Therefore, how to provide a manner that can exclude physical constricting of a pick-up range and effectively listen to the sound of the specific object are required to solve the problems existing in the prior art.

SUMMARY

The purpose of the present disclosure is to provide a directivity hearing-aid device that primarily captures a sound in a range of a beam by using an acoustic wave, and captures the sound (such as a detected sound component) of a specific object based on related processing, then suppresses or shields other sounds (except the detected sound component) to allow the sound of the specific object can be heard by a user, effectively solving the problems of the prior art thereby.

Based on the purpose of the present disclosure, a directivity hearing-aid device is provided, which comprises: a case; an audio pick-up device disposed in the case, receiving a sound within a range pointed by a beam and generating a sound signal; a processor disposed in the case and connected to the audio pick-up device, the processor receiving the sound signal and extracting at least one sound component from the sound signal, comparing sound feature points in the at least one sound component with a plurality of voiceprint data, extracting sound feature point audios of the sound component in the sound feature points conforming to a detecting target by using a deep learning algorithm, amplifying or amplifying and frequency shifting at least one of the sound feature point audios conforming to the detecting target to generate a detected sound component, and suppressing or shielding the sound feature point audios of the other sound components not being amplified and frequency shifted to generate adjusted sound components, wherein the processor performs a combination process to combine the detected sound component and the adjusted sound components to generate an output sound signal; a selector disposed in the case and connected to the processor to receive the sound feature points and select at least one of the sound feature points as the detecting target; a speaker disposed in the case and connected to the processor to receive and output the output sound signal; and a near-end filter, wherein a sound signal is set on the near-end filter as a near-end sound signal and transmitted to the processor when the audio pick-up device receives the sound signal within a predetermined distance, wherein the processor compares a near-end sound feature point of a near-end sound component in the near-end sound signal based on a user voiceprint data, extracts a near-end sound feature point audio of the near-end sound feature point by using the deep learning algorithm when the near-end sound feature point conforming to the user voiceprint data, and generates a self-sound component after suppressing the near-end sound feature point audio to generate the output sound signal, or performs the combination process to combine the detected sound component, the adjusted sound components or a combination of two thereof with the self-sound component, to generate the output sound signal.

In an embodiment, the processor suppresses or shields the near-end sound feature point audio to generate one of the adjusted sound components when the near-end sound feature point does not conform to the user voiceprint data.

In an embodiment, the directivity hearing-aid device includes: a detector disposed in the case to provide an acoustic wave within a detecting range; and a transmitter disposed in the case to apply a separating acoustic wave to the acoustic wave within the detecting range, to separate the acoustic wave into two directional of a first acoustic wave and a second acoustic wave; wherein the audio pick-up device receives the first acoustic wave and the second acoustic wave, and forms the beam on an overlapped area of the first acoustic wave and the second acoustic wave.

In an embodiment, the directivity hearing-aid device includes: a first detector disposed in the case to provide a first acoustic wave within a first detecting range; and a second detector disposed in the case to provide a second acoustic wave within a second detecting range; wherein the audio pick-up device receives the first acoustic wave and the second acoustic wave, and forms the beam on an overlapped area of the first acoustic wave and the second acoustic wave.

In an embodiment, a frequency data is set in the processor, at least one of the sound feature point audios of the sound component conforming to the detecting target is amplified and frequency shifted by the processor to generate the detected sound component when a sound frequency of the sound feature point audio conforming to the detecting target is conformed to the frequency data, at least one of the sound feature point audios of the sound component conforming to the detecting target is amplified by the processor to generate the detected sound component when a sound frequency of the sound feature point audio of the sound component conforming to the detecting target is not conformed to the frequency data.

In an embodiment, the directivity hearing-aid device includes: an activator disposed in the case and connected to the processor and the audio pick-up device, wherein the activator receives the sound signal from the audio pick-up device to determine whether to activate the processor according to a negative decibel threshold by comparing with a sound component data of the sound signal, the activator activates the processor to extract the at least one sound component from the sound signal when the sound component data is beneath than the negative decibel threshold, the activator receives another sound signal continually when the sound component data is above the negative decibel threshold.

In an embodiment, the sound component data includes a decibel value or a frequency value.

In an embodiment, the audio pick-up device receives a plurality of the sound signals within a determination time, and selects one of the sound signals on at least one of negative decibel timing within the determination time and transmits to the processor, wherein the negative decibel timing includes a timing of a sound decibel of the sound signal beneath than a negative decibel threshold.

Another purpose of the present disclosure is to provide a directivity hearing-aid method that primarily captures a sound in a range of a beam by using an acoustic wave, and captures the sound (such as a detected sound component) of a specific object based on related processing, then suppresses or shields other sounds (except the detected sound component) to allow the sound of the specific object can be heard by a user, effectively solving the problems of the prior art thereby.

Based on another purpose of the present disclosure, a directivity hearing-aid method is provided, which applicable to a directivity hearing-aid device, the directivity hearing-aid method comprises: receiving a sound within a range pointed by a beam and generating a sound signal by an audio pick-up device; extracting at least one sound component from the sound signal by a processor; comparing sound feature points in the at least one sound component with a plurality of voiceprint data by the processor; receiving the sound feature points and selecting at least one of the sound feature points as the detecting target by a selector; extracting sound feature point audios of the sound component in the sound feature points conforming to a detecting target by using a deep learning algorithm by the processor; amplifying or amplifying and frequency shifting at least one of the sound feature point audios conforming to the detecting target by the processor to generate a detected sound component, and suppressing or shielding the sound feature point audios of the other sound components not being amplified and frequency shifted to generate adjusted sound components; performing a combination process by the processor to combine the detected sound component and the adjusted sound components and generate an output sound signal; and receiving and outputting the output sound signal by a speaker; wherein the audio pick-up device includes a near-end filter, a sound signal is set on the near-end filter as a near-end sound signal and transmitted to the processor when the audio pick-up device receives the sound signal within a predetermined distance, wherein the processor compares a near-end sound feature point of a near-end sound component in the near-end sound signal based on a user voiceprint data, extracts a near-end sound feature point audio of the near-end sound feature point by using the deep learning algorithm when the near-end sound feature point conforming to the user voiceprint data, and generates a self-sound component after suppressing the near-end sound feature point audio to generate the output sound signal, or performs the combination process to combine the detected sound component, the adjusted sound components or a combination of two thereof with the self-sound component, to generate the output sound signal.

In an embodiment, the processor suppresses or shields the near-end sound feature point audio to generate one of the adjusted sound components when the near-end sound feature point does not conform to the user voiceprint data.

In an embodiment, the directivity hearing-aid method includes: providing an acoustic wave within a detecting range by a detector; and applying a separating acoustic wave to the acoustic wave within the detecting range by a transmitter to separate the acoustic wave into two directional of a first acoustic wave and a second acoustic wave; wherein the audio pick-up device receives the first acoustic wave and the second acoustic wave, and forms the beam on an overlapped area of the first acoustic wave and the second acoustic wave.

In an embodiment, the directivity hearing-aid method includes: providing a first acoustic wave within a first detecting range by a first detector; and providing a second acoustic wave within a second detecting range by a second detector; wherein the audio pick-up device receives the first acoustic wave and the second acoustic wave, and forms the beam on an overlapped area of the first acoustic wave and the second acoustic wave.

In an embodiment, a frequency data is set in the processor, at least one of the sound feature point audios of the sound component conforming to the detecting target is amplified and frequency shifted by the processor to generate the detected sound component when a sound frequency of the sound feature point audio conforming to the detecting target is conformed to the frequency data, at least one of the sound feature point audios of the sound component conforming to the detecting target is amplified by the processor to generate the detected sound component when a sound frequency of the sound feature point audio of the sound component conforming to the detecting target is not conformed to the frequency data.

In an embodiment, the directivity hearing-aid method includes: receiving the sound signal from the audio pick-up device by an activator to determine whether to activate the processor according to a negative decibel threshold by comparing with a sound component data of the sound signal; activating the processor by the activator to extract the at least one sound component from the sound signal when the sound component data is beneath than the negative decibel threshold; or receiving another sound signal continually by the activator when the sound component data is above the negative decibel threshold.

In an embodiment, the sound component data includes a decibel value or a frequency value.

In an embodiment, the audio pick-up device receives a plurality of the sound signals within a determination time, and selects one of the sound signals on at least one of negative decibel timing within the determination time and transmits to the processor, wherein the negative decibel timing includes a timing of a sound decibel of the sound signal beneath than a negative decibel threshold.

In order to lead the purposes, features, and advantages of the present disclosure as described above can be obviously understandable, the specific embodiments listed in the drawings are described in detail below.

DESCRIPTION OF THE PREFERRED EMBODIMENTS

The advantages, features, and technical methods of the present disclosure are to be explained in detail with reference to the exemplary embodiments and the drawings for a better understanding of the present disclosure. Moreover, the present disclosure may be realized in different forms, and should not be construed as being limited to the embodiments set forth herein. Conversely, for a person of ordinary skill in the art, the embodiments provided shall make the present disclosure convey the scope more thoroughly, comprehensively, and completely. In addition, the present disclosure shall be defined only by the appended claims.

The terms used in the present disclosure are only for the purpose of describing specific embodiments, not intended to limit the present disclosure. Unless otherwise defined, the technical terms or scientific terms used in the present disclosure shall have the usual meanings understood by those with ordinary skills in the field to which this disclosure belongs. The "one" or "a" or other similar words used in the specification of the present disclosure and the claims do not mean a limit of quantity, but mean that there is at least one. Unless otherwise stated, "including" or "comprising" or other similar words mean that the elements or objects before "including" or "comprising" contains the elements or objects or their equivalents listed after "including" or "comprising", and other elements or objects are not excluded. Similar words such as "connection" or "connect" are not limited to physical or mechanical connections, and may include electrical connections, no matter whether direct or indirect. The singular forms of "a", "the" and "this" used in the specification and claims of this disclosure are also intended to include plural forms, unless the context clearly indicates other meanings. It should also be understood that the term "and/or" as used herein refers to any or all possible combinations of one or more associated listed items.

Figure 1:
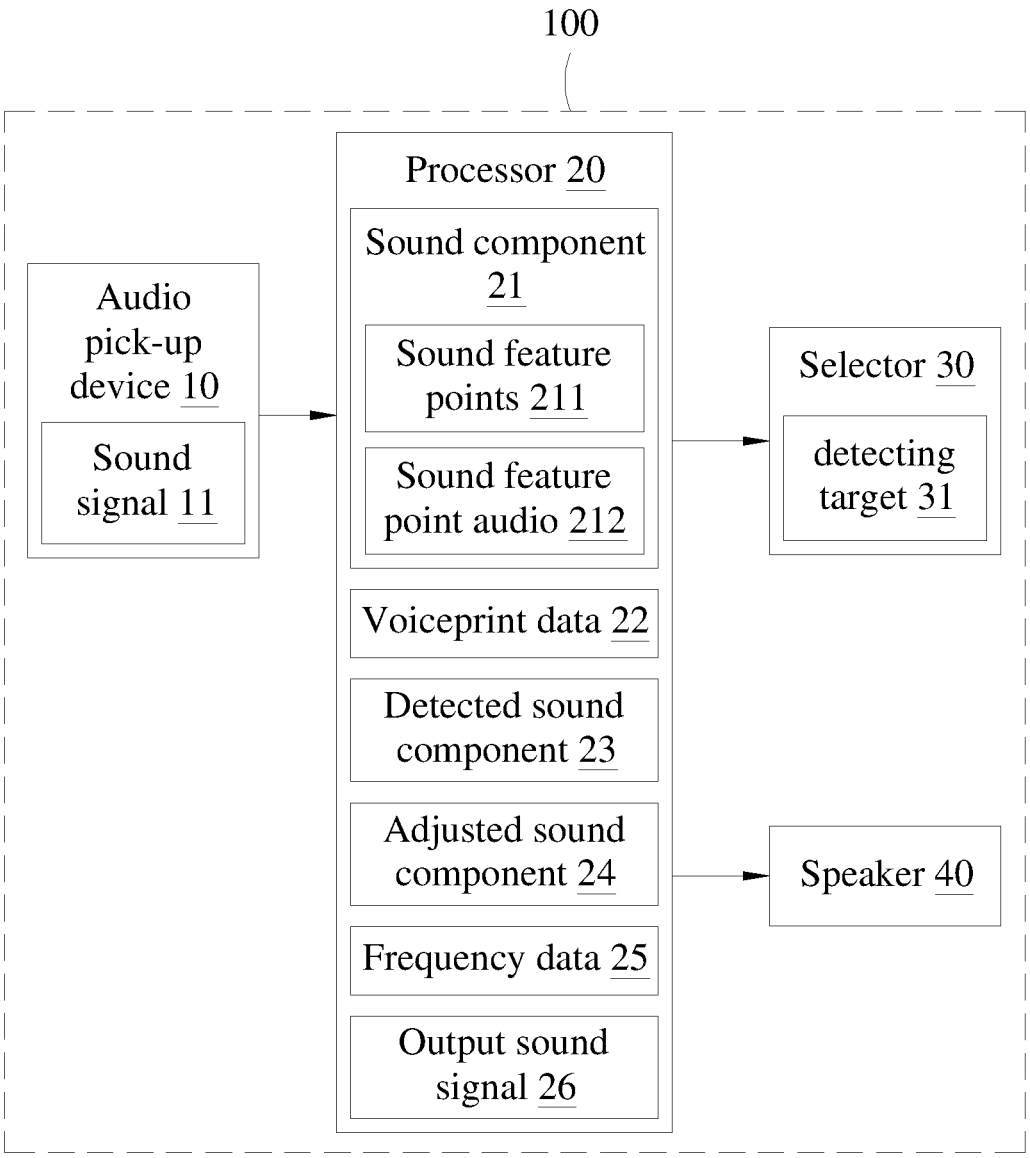
FIG. 1 illustrates a schematic diagram of elements configuration of the present disclosure.

Please refer to FIG. 1 which is a schematic diagram of elements configuration of the present disclosure. As shown in the figure, the present disclosure primarily consists of an audio pick-up device 10, a processor 20, a selector 30 and a speaker 40 in a case 100. The audio pick-up device 10 may specifically be a microphone or other related devices that can receive an external sound. In order to limit a pick-up range of the audio pick-up device 10 in a range pointed by a beam to receive a sound from the range of the beam, moreover, the audio pick-up device 10 may further receive a plurality of the sound signals in a determination time when the sound of a specific object is unable to be effectively captured since the sound in the range of the beam is too noisy, and select one of the sound signals 11 received on at least one negative decibel timing within the determination time and transmit to the processor 20. Wherein the negative decibel timing includes a timing of a sound decibel of the sound signal 11 beneath than a negative decibel threshold (e.g. 60 decibels or other decibel values that will not drown out the sound of the specific object). The configuration purpose of the negative decibel timing is that, for example, the volume of human speech cannot be maintained at a high decibel level for a long time, even if the sounds of classmates are too loud in class environment. Therefore, the audio pick-up device 10 can use the sound signal for subsequent processing and determination when the sound signal 11 on the at least one of negative decibel timing (that is, a timing with low decibels when the classmates are speaking) is captured by the audio pick-up device 10.

The processor 20 may specifically be a central processing unit or other devices capable of data processing. The processor 20 can receive the data from the audio pick-up device 10 when the processor 20 is connected to the audio pick-up device 10. Currently, at least one sound component 21 from the sound signal 11 will be extracted by the processor 20 (such as the sound of a specific object and other human sounds). To effectively distinguish the differences between the sound components 21, and select a specific object based on the differences, so that the processor 20 compares sound feature points 211 in the at least one sound component 21 with a plurality of voiceprint data 22 after each of the sound components 21 is extracted, the plurality of warning voiceprint data 22 can be obtained through a period of sound learning or the data stored in an original register. At this time, the selector 30 can receive the sound feature points 211 by connecting with the processor 20. In an embodiment, a selection interface can be provided by the selector 30 to be selected or automatic selected by the user (e.g. when the specific object to be captured has been set) to select at least one of the sound feature points 211 as a detecting target 31 and transmit to the processor 20.

Sound feature point audios 212 of the sound component 21 in the sound feature points 211 conforming to the detecting target 31 will be extracted by using a deep learning algorithm by the processor 20 when the detecting target 31 is received by the processor 20, and at least one of the sound feature point audios 212 conforming to the detecting target 31 is amplified or amplified and frequency shifted by the processor 20 to generate a detected sound component 23. However, the received sound component 21 may be classified as a sound frequency that cannot be heard, will cause discomfort, and can be heard and without causing discomfort to a user who wears the directivity hearing-aid device of the present disclosure. In order to effectively distinguish the classifications of the sound frequency to which the sound component 21 belonging with, a frequency data 25 can be set in the processor 20, and the detected sound component 23 can be determined as a sound frequency that cannot be heard or will cause discomfort to the user when the sound frequency of at least one of the sound feature point audios 212 conforming to the detecting target 31 is conformed to the frequency data 25, so that at least one of the sound feature point audios 212 conforming to the detecting target 31 will be amplified and frequency shifted (shifting the sound frequency of the detected sound component 23 to a sound frequency that does not conform to the frequency data 25 by using the frequency shifting method) by the processor 20, or the detected sound component 23 can be determined as a sound frequency that can be heard and without causing discomfort to the user when the sound frequency of at least one of the sound feature point audios 212 conforming to the detecting target 31 is not conformed to the frequency data 25, so that at least one of the sound feature point audios 212 conforming to the detecting target 31 will be amplified by the processor 20.

In addition to the aforementioned action of highlighting the detected sound component 23, the processor 20 further suppresses or shields the sound feature point audios 212 in the other sound components 21 those are not amplified and frequency shifted to generate adjusted sound components 24, then performs a combination process for the detected sound component 23 and the adjusted sound components 24, so that the detected sound component 23 and the adjusted sound components 24 are combined to generate an output sound signal 26. Thus, the output sound signal 26 will include the detected sound component 23 that is highlighted and the adjusted sound components 24 that are suppressed or muted.

After that, the speaker 40 can receive the output sound signal 26 by connecting with the processor 20, and output the output sound signal 26 to the user for listening. Furthermore, it is effective to achieve selectively receiving the detected sound component and suppressing or shielding the other impurity sounds to facilitate the user hears the audio from the specific object thereby.

Moreover, since the conversion or performing between digital signals or analog signals is a prior art, in the above-mentioned signal receiving or outputting actions, the actions known in the prior art will not be repeated.

Figure 2:
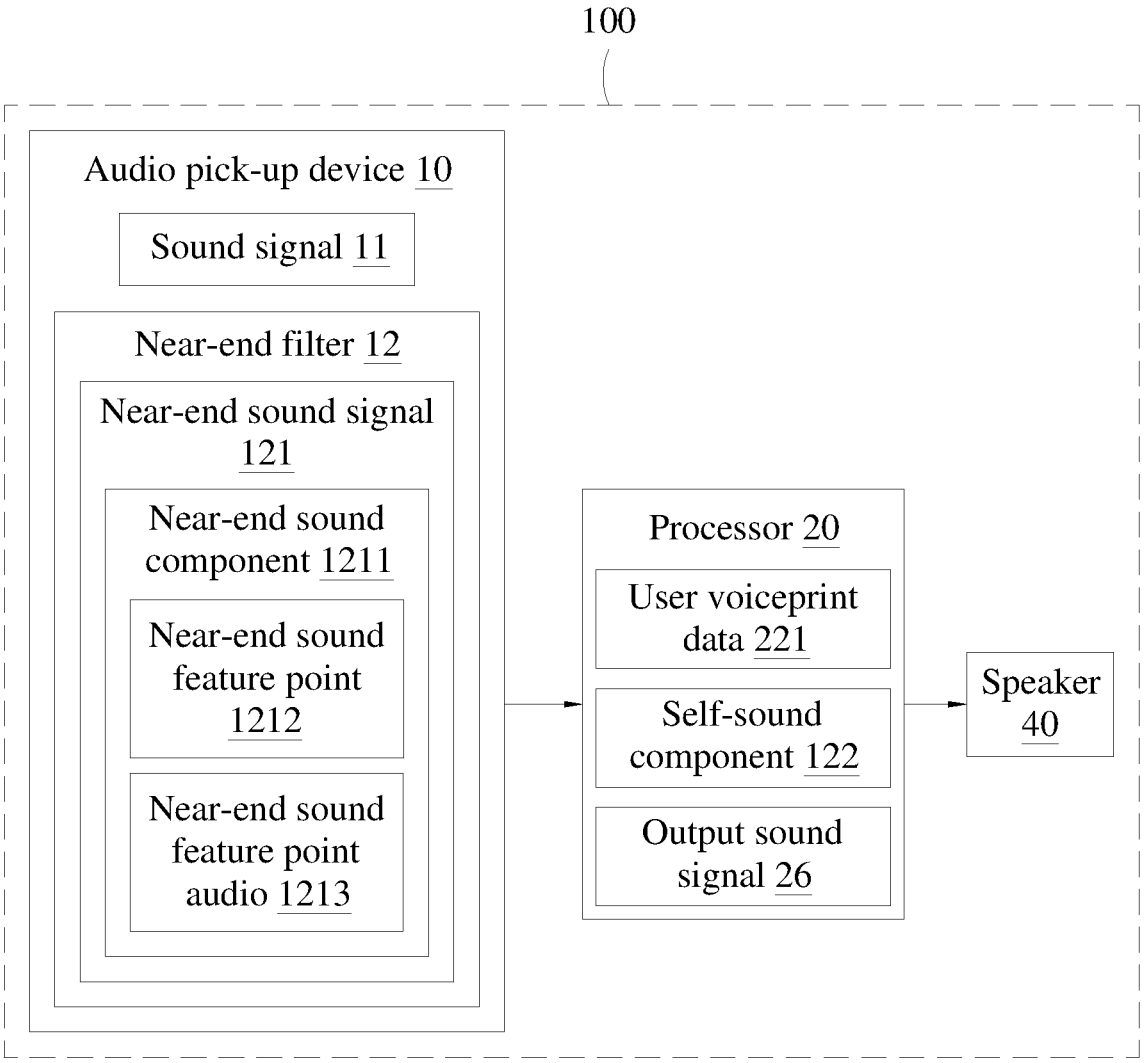
FIG. 2 illustrates a schematic diagram of a near-end filter configuration of the present disclosure.

Please further refer to FIG. 2, which is a schematic diagram of a near-end filter configuration of the present disclosure. As shown in the figure, a sound of the detected sound component 23 can be effectively heard through the above-mentioned actions when the directivity hearing-aid device of the present disclosure is worn by the user, but the volume of the detected sound component 23 may be drowned out when the speaking volume of the user is too loud due to the distance between the user and the directivity hearing-aid device is closest. Consequently, a near-end filter 12 can be provided with the audio pick-up device 10 of the present disclosure to avoid the above situation, a sound signal 11 will be set on the near-end filter 12 as a near-end sound signal 121 and transmitted to the processor 20 when the audio pick-up device 10 receives the sound signal 11 within a predetermined distance (e.g. between 0 cm to 10 cm). Wherein the processor 20 compares a near-end sound feature point 1212 of a near-end sound component 1211 in the near-end sound signal 121 based on a user voiceprint data 221, then the processor 20 extracts a near-end sound feature point audio 1213 of the near-end sound feature point 212 by using the deep learning algorithm when the near-end sound feature point 1212 conforming to the user voiceprint data 221, and generates a self-sound component 122 (that is, the sound made from the user) after suppressing the near-end sound feature point audio 1213 to generate the output sound signal 26 according to the self-sound component 122, or the processor 20 performs the combination process to combine the detected sound component 23, the adjusted sound components 24 or a combination of two thereof with the self-sound component 122, to generate the output sound signal 26. The purpose herein is to prevent the volume of the detected sound component 23 from being drowned out by the speaking volume of the user, so the near-end sound feature point audio 1213 will not be shielded to allow the user to hear his own sound at a certain volume.

The near-end sound feature point audio 1213 may be suppressed or shielded by the processor 20 to generate one of the adjusted sound components 24 (that is, the adjusted sound components 24 as above-mentioned) when the near-end sound feature point 1212 does not conform to the user voiceprint data 221.

Figure 3:
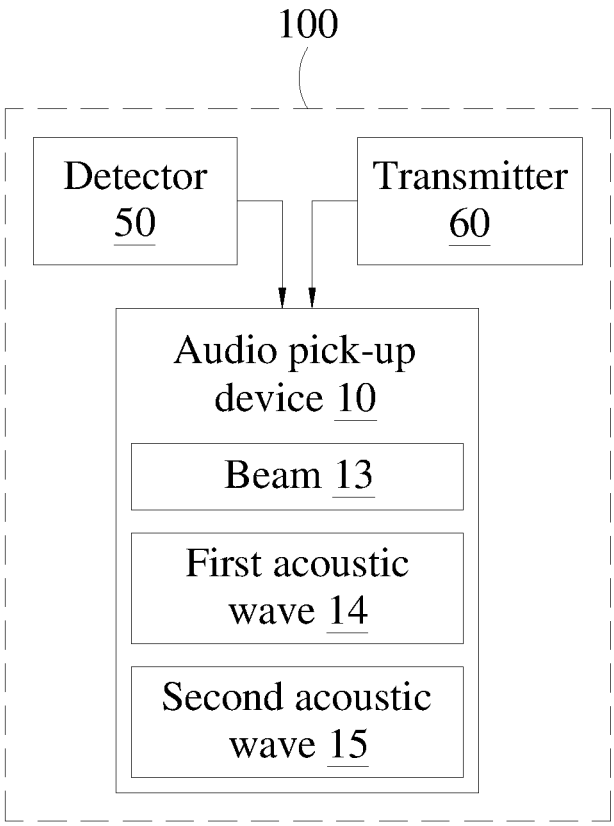
FIG. 3 illustrates an embodiment of a schematic diagram of a detector and a transmitter configuration of the present disclosure.
Figure 4:
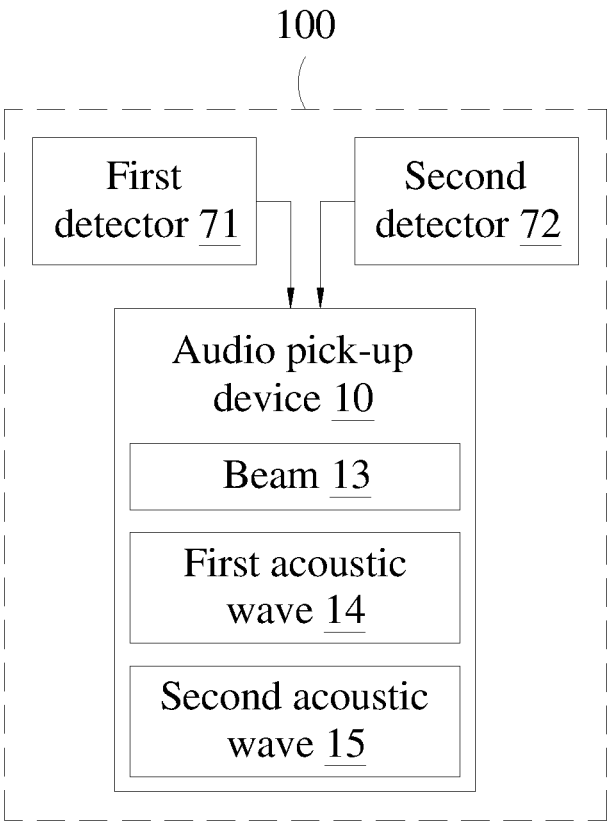
FIG. 4 illustrates another embodiment of a schematic diagram of a first detector and a second detector configuration of the present disclosure.
Figure 5:
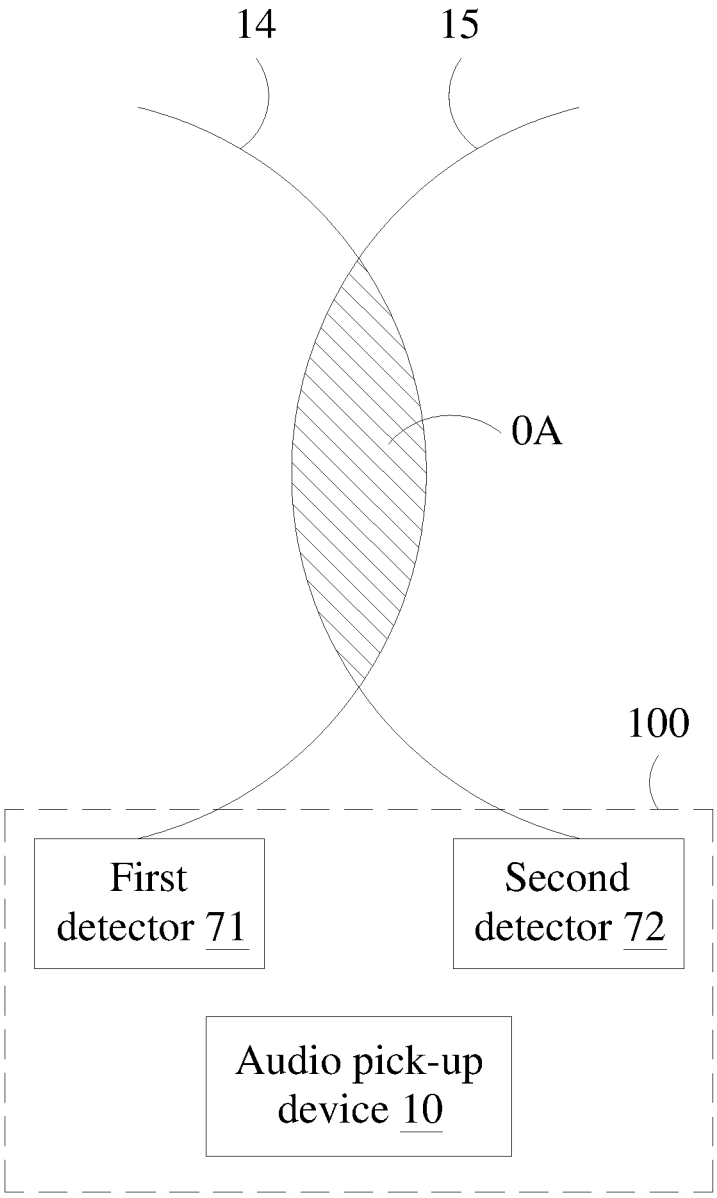
FIG. 5 illustrates a schematic diagram of forming a beam by a first acoustic wave and a second acoustic wave of the present disclosure.

Please further refer to FIGS. 3 to 5, which are an embodiment of a schematic diagram of a detector and a transmitter configuration, another embodiment of a schematic diagram of a first detector and a second detector configuration, and a schematic diagram of forming a beam by a first acoustic wave and a second acoustic wave of the present disclosure. As shown in the figures, in order to effectively provide that the audio pick-up device 10 receives a sound within a range pointed by a beam 13 and generates the sound signal 11, two embodiments of the present disclosure are provided as examples. In one embodiment, the directivity hearing-aid device may include a detector 50 and a transmitter 60 disposed in the case 100. An acoustic wave within a detecting range can be provided by the detector 50, and the detecting range may be directed by, for example, facing to the wide-angle range of the hearing aid device. A separating acoustic is applied to the acoustic wave within the detecting range by a transmitter 60 to separate the acoustic wave into two directional of a first acoustic wave 14 and a second acoustic wave 15, so that an overlapped area OA will be form on between the first acoustic wave 14 and the second acoustic wave 15, at this time, a beam 13 can be formed on the overlapped area OA when the first acoustic wave 14 and the second acoustic wave 15 are received by the audio pick-up device 10 since a function of forming the beam 13 is configured on the audio pick-up device 10, to further receiving the sound from the range of the beam 13 and generating the sound signal 11 accordingly.

In another embodiment, the directivity hearing-aid device may include a first detector 71 and a second detector 72 disposed in the case 100, then providing a first acoustic wave 14 within a first detecting range by the first detector 71, and providing a second acoustic wave 15 within a second detecting range by the second detector 72. Worthily noticeable, in order to provide the audio pick-up device 10 to form the beam 13, an overlapped area OA will be formed with the first detecting range and the second detecting range, to allow the beam 13 being formed on the overlapped area OA when the first acoustic wave 14 and the second acoustic wave 15 are received by the audio pick-up device 10, to further receiving the sound from the range of the beam 13 and generating the sound signal 11 accordingly.

In this way, the effect of directional extraction of the sound signal can be achieved by using the methods provided by the above-mentioned embodiments of the present disclosure.

Figure 6:
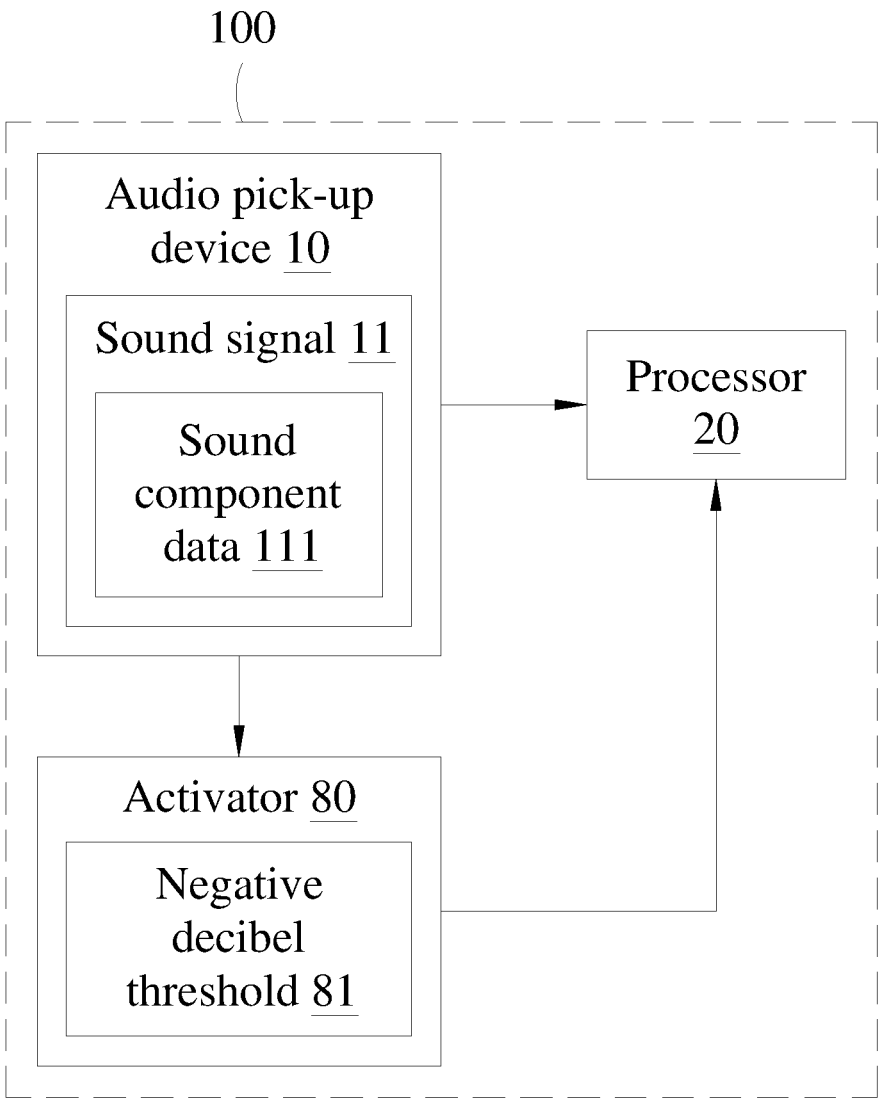
FIG. 6 illustrates a schematic diagram of an activator configuration of the present disclosure.

Please further refer to FIG. 6, which is a schematic diagram of an activator configuration of the present disclosure. As shown in the figure, in order to effectively save power, the directivity hearing-aid device of the present disclosure may further include an activator 80 which is disposed in the case 100 and is connected to the processor 20 and the audio pick-up device 10. The activator 60 receives the sound signal 11 from the audio pick-up device 10 to determine whether to activate the processor 20 according to the negative decibel threshold 81 by comparing a sound component data 111 (e.g. a decibel value) of the sound signal 11. For example, the activator 80 activates the processor 20 to extract the at least one sound component 21 from the sound signal 11 when the sound component data 111 is beneath the negative decibel threshold 81, the activator 80 receives another sound signal 11 continually when the sound component data 111 is above the negative decibel threshold 81, to determine by related activation process. The power-saving function of the directivity hearing-aid device of the present disclosure is effectively provided thereby.

Figure 7:
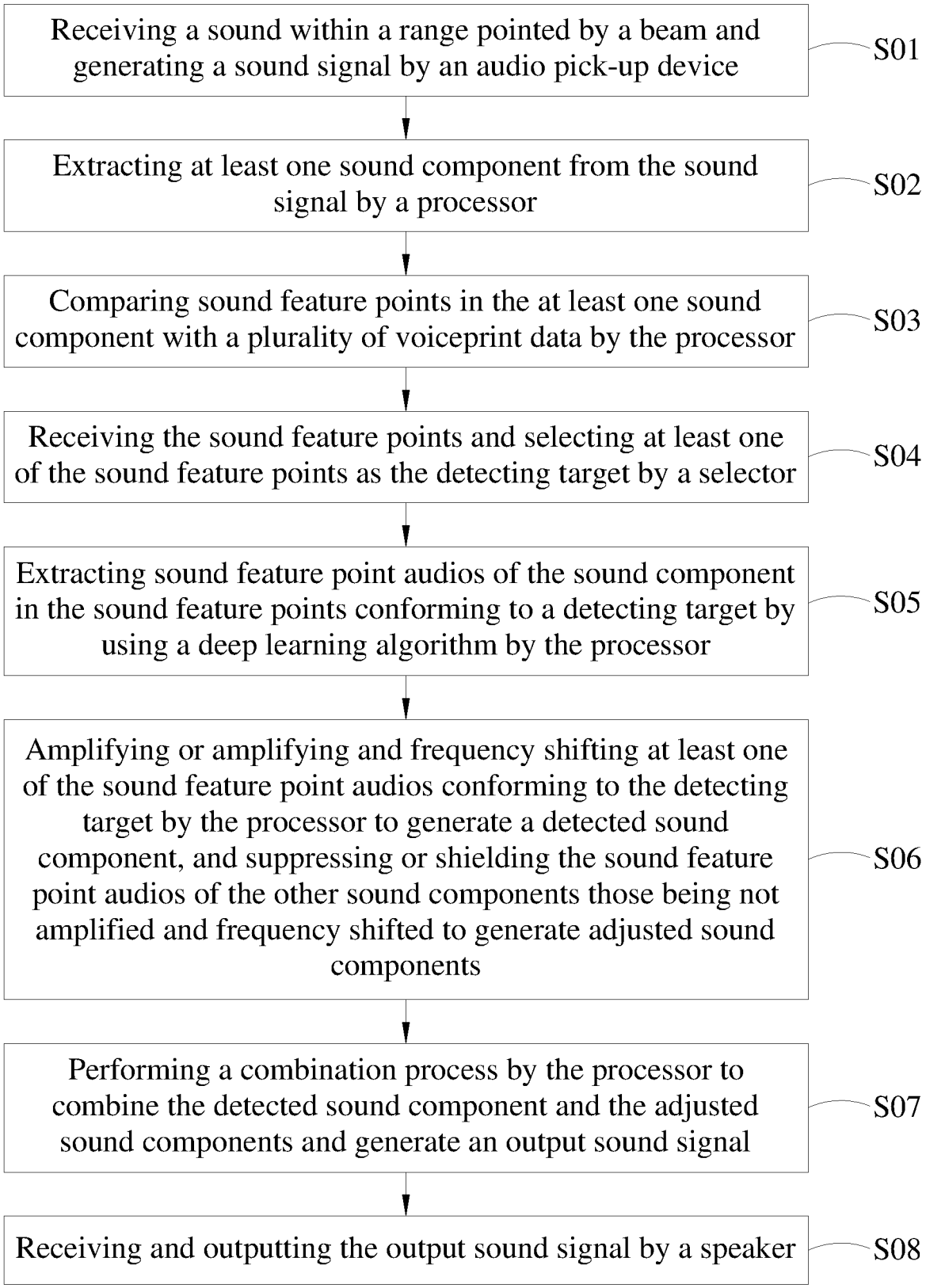
FIG. 7 illustrates a diagram of steps process of the present disclosure.

Please further refer to FIG. 7, which is a diagram of steps process of the present disclosure. As shown in the figure, the effect of effectively hearing the detected sound component as the above-mentioned can be achieved by the following steps process, which includes:

S01: receiving a sound within a range pointed by a beam and generating a sound signal by an audio pick-up device;

S02: extracting at least one sound component from the sound signal by a processor;

S03: comparing sound feature points in the at least one sound component with a plurality of voiceprint data by the processor;

S04: receiving the sound feature points and selecting at least one of the sound feature points as the detecting target by a selector;

S05: extracting sound feature point audios of the sound component in the sound feature points conforming to a detecting target by using a deep learning algorithm by the processor;

S06: amplifying or amplifying and frequency shifting at least one of the sound feature point audios conforming to the detecting target by the processor to generate a detected sound component, and suppressing or shielding the sound feature point audios of the other sound components not being amplified and frequency shifted to generate adjusted sound components;

S07: performing a combination process by the processor to combine the detected sound component and the adjusted sound components and generate an output sound signal;

S08: receiving and outputting the output sound signal by a speaker.

Accordingly, the directivity hearing-aid device of the present disclosure can selectively receive the detected sound component and suppressing or shielding the other impurity sounds to facilitate the user hears audio from a specific object thereby.

The above description is merely illustrative rather than restrictive. Any equivalent modifications or alterations without departing from the spirit and scope of the present disclosure are intended to be included in the following claims.

In summary, regardless of the purposes, means, and effects of the present disclosure, which is showing the technical characteristics that are different from the prior art, and it is invented suitable for practical use, and also in compliance with the patent requirements of the present disclosure. Praying that the patent will be granted as soon as possible, so as to benefit society.

What is claimed is:

1. A directivity hearing-aid device, comprising:

a case;

an audio pick-up device disposed in the case, receiving a sound within a range pointed by a beam and generating a sound signal;

a processor disposed in the case and connected to the audio pick-up device, the processor receiving the sound signal and extracting at least one sound component from the sound signal, comparing sound feature points in the at least one sound component with a plurality of voiceprint data, extracting sound feature point audios of the sound component in the sound feature points conforming to a detecting target by using a deep learning algorithm, amplifying or amplifying and frequency shifting at least one of the sound feature point audios conforming to the detecting target to generate a detected sound component, and suppressing or shielding the sound feature point audios of the other sound components not being amplified and frequency shifted to generate adjusted sound components, wherein the processor performs a combination process to combine the detected sound component and the adjusted sound components to generate an output sound signal;

a selector disposed in the case and connected to the processor to receive the sound feature points and select at least one of the sound feature points as the detecting target;

a speaker disposed in the case and connected to the processor to receive and output the output sound signal; and a near-end filter, wherein a sound signal is set on the near-end filter as a near-end sound signal and transmitted to the processor when the audio pick-up device receives the sound signal within a predetermined distance, wherein the processor compares a near-end sound feature point of a near-end sound component in the near-end sound signal based on a user voiceprint data, extracts a near-end sound feature point audio of the near-end sound feature point by using the deep learning algorithm when the near-end sound feature point conforming to the user voiceprint data, and generates a self-sound component after suppressing the near-end sound feature point audio to generate the output sound signal, or performs the combination process to combine the detected sound component, the adjusted sound components or a combination of two thereof with the self-sound component, to generate the output sound signal.

2. The directivity hearing-aid device according to claim 1, wherein the processor suppresses or shields the near-end sound feature point audio to generate one of the adjusted sound components when the near-end sound feature point does not conform to the user voiceprint data.

3. The directivity hearing-aid device according to claim 1, comprising:

a detector disposed in the case to provide an acoustic wave within a detecting range; and a transmitter disposed in the case to apply a separating acoustic wave to the acoustic wave within the detecting range, to separate the acoustic wave into two directional of a first acoustic wave and a second acoustic wave;

wherein the audio pick-up device receives the first acoustic wave and the second acoustic wave, and forms the beam on an overlapped area of the first acoustic wave and the second acoustic wave.

4. The directivity hearing-aid device according to claim 1, comprising:

a first detector disposed in the case to provide a first acoustic wave within a first detecting range; and a second detector disposed in the case to provide a second acoustic wave within a second detecting range;

wherein the audio pick-up device receives the first acoustic wave and the second acoustic wave, and forms the beam on an overlapped area of the first acoustic wave and the second acoustic wave.

5. The directivity hearing-aid device according to claim 1, wherein a frequency data is set in the processor, at least one of the sound feature point audios of the sound component conforming to the detecting target is amplified and frequency shifted by the processor to generate the detected sound component when a sound frequency of the sound feature point audio conforming to the detecting target is conformed to the frequency data, at least one of the sound feature point audios of the sound component conforming to the detecting target is amplified by the processor to generate the detected sound component when a sound frequency of the sound feature point audio of the sound component conforming to the detecting target is not conformed to the frequency data.

6. The directivity hearing-aid device according to claim 1, comprising:

an activator disposed in the case and connected to the processor and the audio pick-up device, wherein the activator receives the sound signal from the audio pick-up device to determine whether to activate the processor according to a negative decibel threshold by comparing with a sound component data of the sound signal, the activator activates the processor to extract the at least one sound component from the sound signal when the sound component data is beneath than the negative decibel threshold, the activator receives another sound signal continually when the sound component data is above the negative decibel threshold.

7. The directivity hearing-aid device according to claim 6, wherein the sound component data includes a decibel value or a frequency value.

8. The directivity hearing-aid device according to claim 1, wherein the audio pick-up device receives a plurality of the sound signals within a determination time, and selects one of the sound signals on at least one of negative decibel timing within the determination time and transmits to the processor, wherein the negative decibel timing includes a timing of a sound decibel of the sound signal beneath than a negative decibel threshold.

9. A directivity hearing-aid method, applicable to a directivity hearing-aid device, the directivity hearing-aid method comprising:

receiving a sound within a range pointed by a beam and generating a sound signal by an audio pick-up device;

extracting at least one sound component from the sound signal by a processor;

comparing sound feature points in the at least one sound component with a plurality of voiceprint data by the processor;

receiving the sound feature points and selecting at least one of the sound feature points as the detecting target by a selector;

extracting sound feature point audios of the sound component in the sound feature points conforming to a detecting target by using a deep learning algorithm by the processor;

amplifying or amplifying and frequency shifting at least one of the sound feature point audios conforming to the detecting target by the processor to generate a detected sound component, and suppressing or shielding the sound feature point audios of the other sound components not being amplified and frequency shifted to generate adjusted sound components;

performing a combination process by the processor to combine the detected sound component and the adjusted sound components and generate an output sound signal;

receiving and outputting the output sound signal by a speaker;

wherein the audio pick-up device includes a near-end filter, a sound signal is set on the near-end filter as a near-end sound signal and transmitted to the processor when the audio pick-up device receives the sound signal within a predetermined distance, wherein the processor compares a near-end sound feature point of a near-end sound component in the near-end sound signal based on a user voiceprint data, extracts a near-end sound feature point audio of the near-end sound feature point by using the deep learning algorithm when the near-end sound feature point conforming to the user voiceprint data, and generates a self-sound component after suppressing the near-end sound feature point audio to generate the output sound signal, or performs the combination process to combine the detected sound component, the adjusted sound components or a combination of two thereof with the self-sound component, to generate the output sound signal.

10. The directivity hearing-aid method according to claim 9, wherein the processor suppresses or shields the near-end sound feature point audio to generate one of the adjusted sound components when the near-end sound feature point does not conform to the user voiceprint data.

11. The directivity hearing-aid method according to claim 9, comprising:

providing an acoustic wave within a detecting range by a detector; and applying a separating acoustic wave to the acoustic wave within the detecting range by a transmitter to separate the acoustic wave into two directional of a first acoustic wave and a second acoustic wave;

wherein the audio pick-up device receives the first acoustic wave and the second acoustic wave, and forms the beam on an overlapped area of the first acoustic wave and the second acoustic wave.

12. The directivity hearing-aid method according to claim 9, comprising:

providing a first acoustic wave within a first detecting range by a first detector; and providing a second acoustic wave within a second detecting range by a second detector;

wherein the audio pick-up device receives the first acoustic wave and the second acoustic wave, and forms the beam on an overlapped area of the first acoustic wave and the second acoustic wave.

13. The directivity hearing-aid method according to claim 9, wherein a frequency data is set in the processor, at least one of the sound feature point audios of the sound component conforming to the detecting target is amplified and frequency shifted by the processor to generate the detected sound component when a sound frequency of the sound feature point audio conforming to the detecting target is conformed to the frequency data, at least one of the sound feature point audios of the sound component conforming to the detecting target is amplified by the processor to generate the detected sound component when a sound frequency of the sound feature point audio of the sound component conforming to the detecting target is not conformed to the frequency data.

14. The directivity hearing-aid method according to claim 9, comprising:

receiving the sound signal from the audio pick-up device by an activator to determine whether to activate the processor according to a negative decibel threshold by comparing with a sound component data of the sound signal;

activating the processor by the activator to extract the at least one sound component from the sound signal when the sound component data is beneath than the negative decibel threshold; or receiving another sound signal continually by the activator when the sound component data is above the negative decibel threshold.

15. The directivity hearing-aid method according to claim 14, wherein the sound component data includes a decibel value or a frequency value.

16. The directivity hearing-aid method according to claim 9, wherein the audio pick-up device receives a plurality of the sound signals within a determination time, and selects one of the sound signals on at least one of negative decibel timing within the determination time and transmits to the processor, wherein the negative decibel timing includes a timing of a sound decibel of the sound signal beneath than a negative decibel threshold.

* * * * *